US009162151B1

(12) United States Patent
James

(10) Patent No.: US 9,162,151 B1
(45) Date of Patent: Oct. 20, 2015

(54) SAFETY ASSEMBLY

(71) Applicant: Ray James, Sapulpa, OK (US)

(72) Inventor: Ray James, Sapulpa, OK (US)

( * ) Notice: Subject to any disclaimer, the term of this patent is extended or adjusted under 35 U.S.C. 154(b) by 0 days.

(21) Appl. No.: 14/165,760

(22) Filed: Jan. 28, 2014

(51) Int. Cl.
*A63G 9/12* (2006.01)
*A47D 1/10* (2006.01)

(52) U.S. Cl.
CPC ..... *A63G 9/12* (2013.01)

(58) Field of Classification Search
CPC ..... A63G 9/00; A63G 9/02; A63G 9/12; A63G 9/14; A47D 1/10; A47D 13/105; A47D 13/107
USPC ..... 472/118–125; 297/273, 274
See application file for complete search history.

(56) References Cited

U.S. PATENT DOCUMENTS

| | | | | |
|---|---|---|---|---|
| 182,542 | A | 9/1876 | Blakeslee | |
| 1,379,082 | A | 5/1921 | Cavanaugh | |
| 2,669,286 | A | 2/1954 | Rink | |
| 2,757,714 | A * | 8/1956 | Hurley | 472/121 |
| D340,104 | S | 10/1993 | Nolan | |
| 5,529,539 | A * | 6/1996 | Hoffman | 472/118 |
| 6,974,388 | B1 * | 12/2005 | Williams, Jr. | 472/118 |
| 7,837,568 | B1 | 11/2010 | Glaze | |
| 2003/0040372 | A1 | 2/2003 | McNutt et al. | |

FOREIGN PATENT DOCUMENTS

| | | |
|---|---|---|
| EP | 1208889 | 9/2004 |
| EP | 1749561 | 2/2007 |

* cited by examiner

*Primary Examiner* — Kien Nguyen

(57) ABSTRACT

A safety assembly for preventing a swing from twisting includes a frame coupled to a swing set frame. The frame may support the swing. A retainer is coupled between the frame and the swing set frame. The frame is retained on the swing set frame. A stabilizing arm is coupled to the frame. The stabilizing arm prevents the frame from rotating.

15 Claims, 3 Drawing Sheets

SAFETY ASSEMBLY

BACKGROUND OF THE DISCLOSURE

Field of the Disclosure

The disclosure relates to safety devices and more particularly pertains to a new safety device for preventing a swing from twisting.

SUMMARY OF THE DISCLOSURE

An embodiment of the disclosure meets the needs presented above by generally comprising a frame coupled to a swing set frame. The frame may support the swing. A retainer is coupled between the frame and the swing set frame. The frame is retained on the swing set frame. A stabilizing arm is coupled to the frame. The stabilizing arm prevents the frame from rotating.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
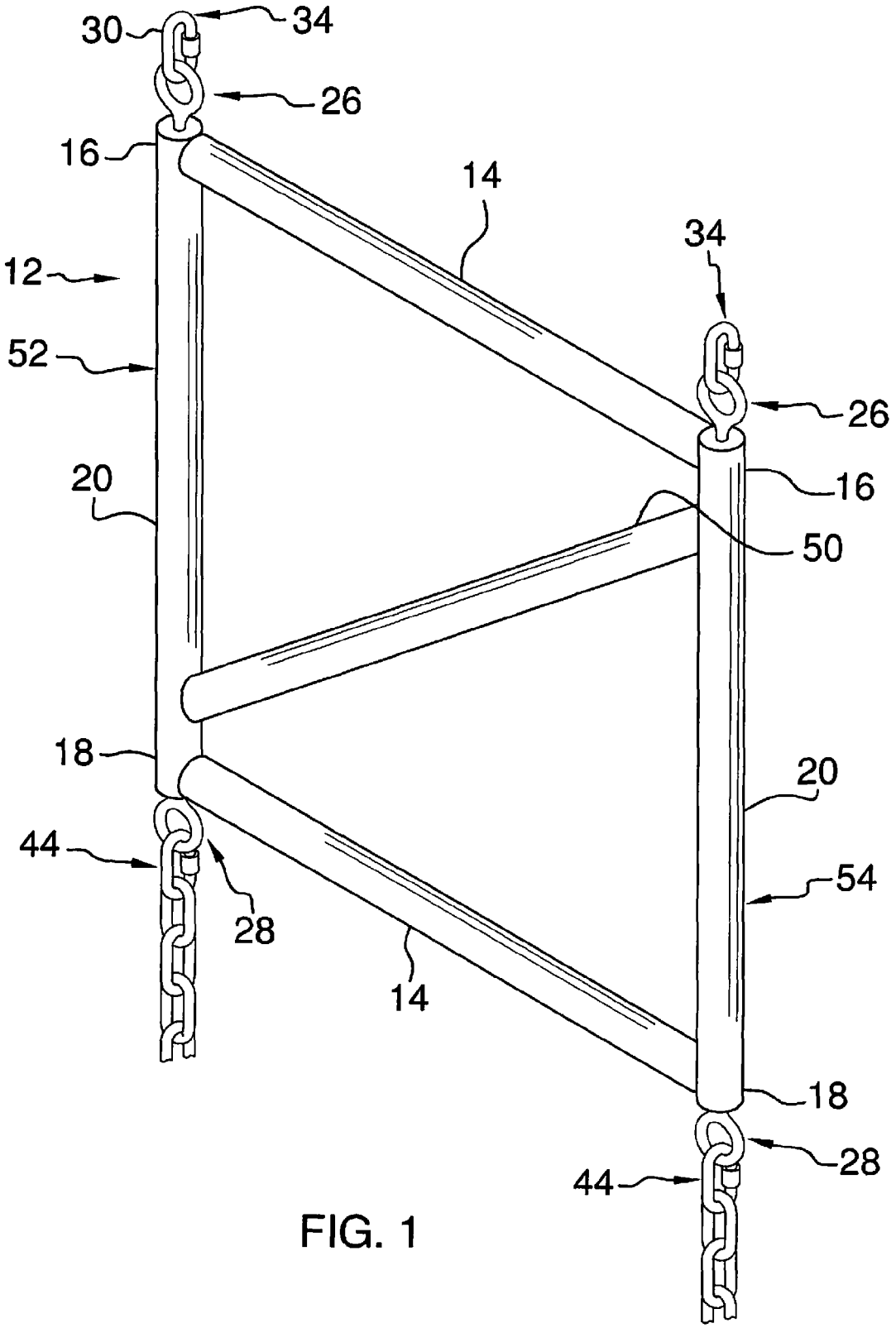
FIG. 1 is a perspective view of a safety assembly according to an embodiment of the disclosure.
Figure 3:
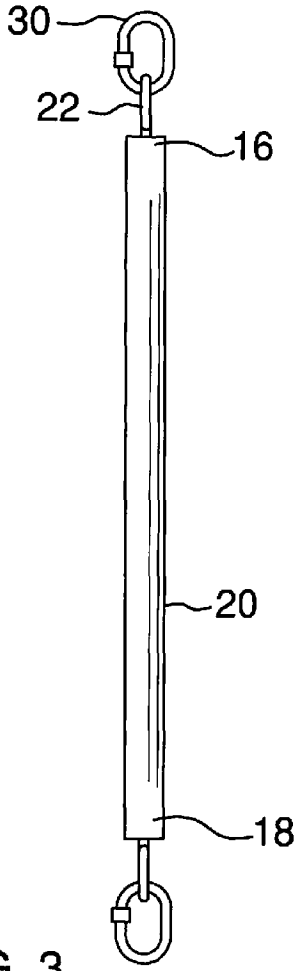
FIG. 3 is a right side view of an embodiment of the disclosure.
Figure 2:
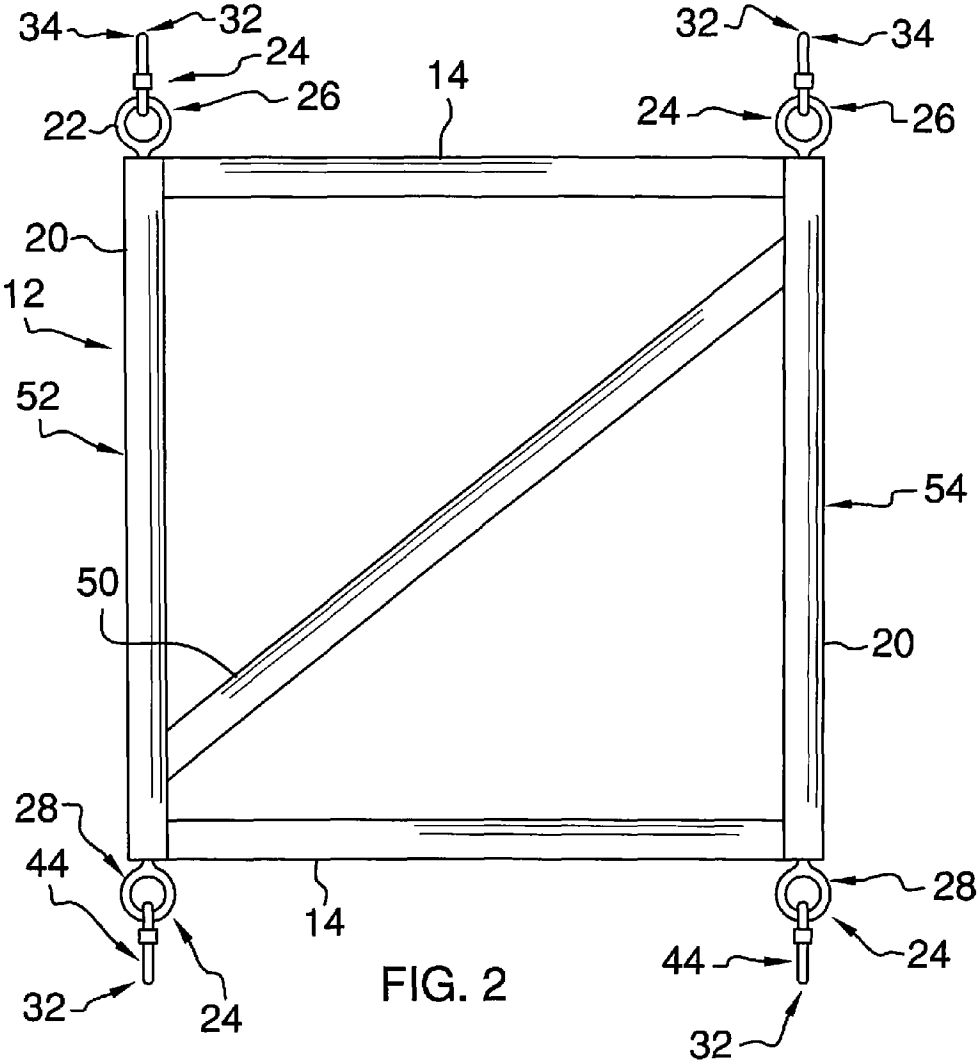
FIG. 2 is a front view of an embodiment of the disclosure.
Figure 4:
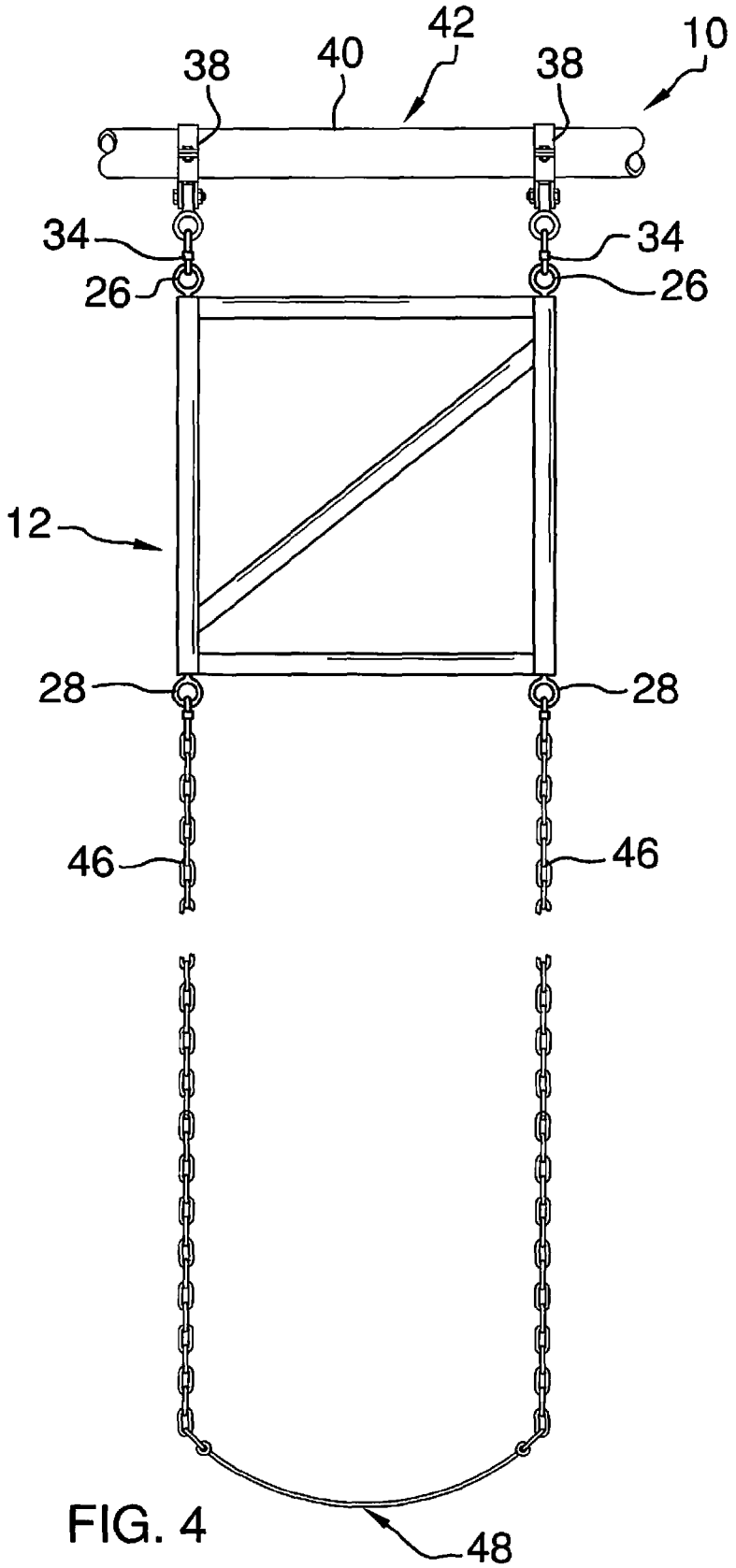
FIG. 4 is an in-use view of an embodiment of the disclosure.

With reference now to the drawings, and in particular to FIGS. 1 through 4 thereof, a new safety device embodying the principles and concepts of an embodiment of the disclosure and generally designated by the reference numeral 10 will be described.

As best illustrated in FIGS. 1 through 4, the safety assembly 10 generally comprises a frame 12. Each of a pair of lateral arms 14 of the frame 12 are coupled between associated ones of a top end 16 and a bottom end 18 of each of a pair of vertical arms 20 of the frame 12. Additionally, the frame 12 has a rectangular shape that may have a length and a width between 45 cm and 60 cm. Each of the pair of lateral arms 14 and the pair of vertical arms 20 of the frame 12 may have a tubular shape.

A ring 22 is coupled to the frame 12. The ring 22 may have a diameter between 2 cm and 5 cm. Further, the ring 22 is one of a plurality of the rings 22. Moreover, the plurality of rings 22 comprises a pair of sets of the rings 24. Each of a first one of the pair of sets of the rings 26 is coupled to the top end 16 of an associated one of the pair of vertical arms 20 of the frame 12. Lastly, each of a second one of the pair of sets of the rings 28 is coupled to the bottom end 18 of an associated one of the pair of vertical arms 20 of the frame 12.

A retainer 30 is provided. The retainer 30 is one of a plurality of retainers 30. Further, the plurality of retainers 30 comprises a pair of sets of the retainers 32. Each of a first one of the pair of sets of the retainers 34 is coupled to an associated one of the first set of rings 26. Additionally, each of the first set of retainers 34 is coupled to an associated one of a pair of swing couplers 38 on a top post 40 of a swing set frame 42. The frame 12 extends downwardly from the top post 40 of the swing set frame 42.

Each of a second one of the pair of sets of the retainers 44 is coupled to an associated one of the second set of rings 28. Moreover, each of a pair of chains 46 of a swing 48 is coupled to an associated one of the second set of retainers 44. The swing 48 extends downwardly from the frame 12. Both the swing set frame 42 and the swing 48 may be a playground swing set frame and a playground swing of any conventional design.

A stabilizing arm 50 of the frame 12 is coupled to and extends diagonally between an associated one of the top 16 and bottom ends 18 of each of a first one 52 and a second one 54 of the pair of vertical arms of the frame 12. The stabilizing arm 50 of the frame 12 may have a length between 60 cm and 85 cm. Lastly, the stabilizing arm 50 of the frame 12 prevents the frame 12 from rotating.

In use, the swing 48 is utilized in the traditional convention of a swing set. Continuing, the frame 12 prevents the pair of chains 46 of the swing 48 from twisting while the swing 48 is utilized. The frame 12 allows unrestricted forward and rearward motion of the swing 48 with respect to the top post 40 of the swing set frame 42. Lastly, the frame 12 is removable at any time from the top post 40 of the swing set frame 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A safety assembly for preventing a swing from twisting, said assembly comprising:

a frame coupled to a swing set frame wherein said frame is configured to support the swing;

a retainer coupled between said frame and the swing set frame wherein said frame is retained on the swing set frame; and a stabilizing arm coupled to said frame wherein said stabilizing arm prevents said frame from rotating; and a ring coupled to said frame.

2. The assembly according to claim 1 further comprising said frame comprising a pair of lateral arms of said frame coupled between associated ones of a top end and a bottom end of each of a pair of vertical arms of said frame.

3. The assembly according to claim 2 further comprising wherein said frame has a rectangular shape.

4. The assembly according to claim 1 further comprising said ring being one of a plurality of said rings.

5. The assembly according to claim 4 further comprising said plurality of rings comprising a pair of sets of said rings.

6. The assembly according to claim 5 further comprising each of a first one of said pair of sets of said rings being coupled to a top end of an associated one of a pair of vertical arms of said frame.

7. The assembly according to claim 5 further comprising each of a second one of said pair of sets of said rings being coupled to a bottom end of an associated one of a pair of vertical arms of said frame.

8. The assembly according to claim 1 further comprising said retainer being one of a plurality of retainers.

9. The assembly according to claim 8 further comprising said plurality of retainers comprising a pair of sets of said retainers.

10. The assembly according to claim 1 further comprising each of a first set of retainers being coupled to a top post of the swing set frame wherein said frame extends downwardly from the top post of the swing set frame.

11. The assembly according to claim 1 further comprising each of a pair chains of the swing being coupled to an associated one of a second set of retainers wherein the swing extends downwardly from said frame.

12. The assembly according to claim 1 further comprising said stabilizing arm of said frame being coupled to and extending diagonally between an associated one of a top end and a bottom end of each of a first one and a second one of a pair of vertical arms of said frame.

13. The assembly of claim 1, further comprising:

said frame comprising a pair of lateral arms of said frame coupled between associated ones of a top end and a bottom end of each of a pair of vertical arms of said frame wherein said frame has a rectangular shape;

said ring being one of a plurality of said rings;

said plurality of rings comprising a pair of sets of said rings;

each of a first one of said pair of sets of said rings being coupled to said top end of an associated one of said pair of vertical arms of said frame;

each of a second one of said pair of sets of said rings being coupled to said bottom end of an associated one of said pair of vertical arms of said frame;

said retainer being one of a plurality of retainers;

said plurality of retainers comprising a pair of sets of said retainers;

each of a first one of said pair of sets of said retainers being coupled to an associated one of said first set of rings, each of said first set of retainers being coupled to a top post of the swing set frame wherein said frame extends downwardly from the top post of the swing set frame;

each of a second one of said pair of sets of said retainers being coupled to an associated one of said second set of rings, each of a pair of chains of the swing being coupled to an associated one of said second set of retainers wherein the swing extends downwardly from said frame; and said stabilizing arm being coupled to and extending diagonally between an associated one of said top and bottom ends of each of a first one and a second one of said pair of vertical arms of said frame.

14. A safety assembly for preventing a swing from twisting, said assembly comprising:

a frame coupled to a swing set frame wherein said frame is configured to support the swing;

a retainer coupled between said frame and the swing set frame wherein said frame is retained on the swing set frame, said retainer being one of a plurality of retainers, said plurality of retainers comprising a pair of sets of said retainers;

a stabilizing arm coupled to said frame wherein said stabilizing arm prevents said frame from rotating; and each of a first one of said pair of sets of said retainers being coupled to an associated one of a first set of rings.

15. A safety assembly for preventing a swing from twisting, said assembly comprising:

a frame coupled to a swing set frame wherein said frame is configured to support the swing;

a retainer coupled between said frame and the swing set frame wherein said frame is retained on the swing set frame, said retainer being one of a plurality of retainers, said plurality of retainers comprising a pair of sets of said retainers;

a stabilizing arm coupled to said frame wherein said stabilizing arm prevents said frame from rotating; and each of a second one of said pair of sets of said retainers being coupled to an associated one of a second set of rings.

* * * * *